US008474063B2

(12) United States Patent
Coulter et al.

(10) Patent No.: US 8,474,063 B2
(45) **Date of Patent: *Jul. 2, 2013**

(54) GLOVE WITH MULTI-ELEMENT DORSAL STIFFENERS

(75) Inventors: Ryan C. Coulter, Portland, OR (US); Michael C. Kemery, Portland, OR (US); Cedar Miller, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 672 days.

This patent is subject to a terminal disclaimer.

(21) Appl. No.: 12/342,216

(22) Filed: Dec. 23, 2008

(65) Prior Publication Data

US 2009/0100573 A1 Apr. 23, 2009

Related U.S. Application Data

(63) Continuation of application No. 11/189,988, filed on Jul. 27, 2005, now Pat. No. 7,475,433.

(51) Int. Cl.
*A41D 19/00* (2006.01)

(52) U.S. Cl.
USPC ..... 2/161.1; 2/160; 2/162

(58) Field of Classification Search
USPC ..... 2/16, 20, 159, 160, 161.1, 161.4, 2/161.6, 162, 166
See application file for complete search history.

(56) References Cited

U.S. PATENT DOCUMENTS 785,190 A * 3/1905 Urwick ..... 2/169
811,389 A 1/1906 Ferry
859,097 A 7/1907 Miller
883,761 A 4/1908 Taylor et al.
2,154,197 A 10/1937 Callaway
3,049,717 A * 8/1962 Meyer ..... 2/16
3,124,806 A 3/1964 Campbell et al.
3,175,226 A * 3/1965 Weinberg ..... 2/159
3,194,233 A 7/1965 Peckham
3,707,730 A 1/1973 Slider
3,728,738 A * 4/1973 Andolino ..... 2/161.1
3,882,548 A * 5/1975 Shinagawa et al. ..... 2/20
3,944,220 A 3/1976 Fasano
4,021,640 A * 5/1977 Gross et al. ..... 219/211

(Continued)

FOREIGN PATENT DOCUMENTS

JP 7213675 8/1995

OTHER PUBLICATIONS

U.S. Appl. No. 10/246,754.

(Continued)

*Primary Examiner* — Khoa Huynh
*Assistant Examiner* — Sally Haden
(74) *Attorney, Agent, or Firm* — Banner & Witcoff, Ltd.

(57) ABSTRACT

A glove includes two "H" shaped stiffening battens on a dorsal side. The battens terminate on a proximal side of the second through fifth fingers, and are formed from a non-rigid material. A one-piece protective panel is attached to the palmar side of the glove. The protective panel covers portions of the wearing hand palm corresponding to the distal ends of the second through fifth metacarpal bones, as well as palmar side portions of the second through fifth digits corresponding to the second through fifth proximal phalanx bones. Flex notch cut-outs in the protective panel correspond to portions of the palmar region which tend to bunch during gripping of a bar or other object and help prevent discomfort during such gripping.

16 Claims, 13 Drawing Sheets

U.S. PATENT DOCUMENTS

| | | | | | |
|---|---|---|---|---|---|
| 4,042,975 | A | | 8/1977 | Elliott, Jr. et al. | |
| 4,067,063 | A | | 1/1978 | Ettinger | |
| 4,272,849 | A | * | 6/1981 | Thurston et al. | 2/16 |
| 4,353,362 | A | | 10/1982 | DeMarco | |
| 4,546,495 | A | | 10/1985 | Castillo | |
| 4,766,612 | A | | 8/1988 | Patton, Sr. | |
| 4,768,234 | A | * | 9/1988 | Yamamoto | 2/16 |
| 4,813,079 | A | | 3/1989 | Reitzel | |
| 4,872,448 | A | | 10/1989 | Johnson, Jr. | |
| 4,881,275 | A | | 11/1989 | Cazares et al. | |
| 4,891,845 | A | | 1/1990 | Hayes | |
| 4,937,882 | A | | 7/1990 | Hayes | |
| 5,031,238 | A | | 7/1991 | Hayes | |
| 5,031,640 | A | | 7/1991 | Spitzer | |
| 5,113,526 | A | * | 5/1992 | Wang et al. | 2/2.5 |
| 5,214,798 | A | | 6/1993 | McLaughlin | |
| 5,345,609 | A | | 9/1994 | Fabry et al. | |
| 5,373,585 | A | | 12/1994 | Wiggins | |
| 5,453,064 | A | | 9/1995 | Williams, Jr. | |
| 5,492,331 | A | | 2/1996 | Kawakami | |
| 5,517,694 | A | | 5/1996 | Fabry | |
| 5,527,244 | A | | 6/1996 | Waller et al. | |
| 5,544,362 | A | | 8/1996 | Synek | |
| 5,581,809 | A | | 12/1996 | Mah | |
| 5,640,712 | A | | 6/1997 | Hansen et al. | |
| 5,697,103 | A | | 12/1997 | Wiggins | |
| 5,708,979 | A | | 1/1998 | Redwood et al. | |
| 5,768,710 | A | | 6/1998 | Williams | |
| 5,810,753 | A | | 9/1998 | Eberbach | |
| 6,006,751 | A | | 12/1999 | Spitzer | |
| 6,105,162 | A | | 8/2000 | Douglas et al. | |
| 6,289,515 | B1 | | 9/2001 | Fous | |
| 6,415,445 | B1 | * | 7/2002 | Nishijima et al. | 2/161.4 |
| 6,526,592 | B1 | | 3/2003 | Best | |
| 6,539,551 | B1 | | 4/2003 | Jones, Jr. | |
| 6,543,058 | B2 | | 4/2003 | Litke | |
| 6,681,402 | B1 | | 1/2004 | Bevier et al. | |
| 6,772,441 | B2 | | 8/2004 | Lucas, Jr. | |
| 6,944,884 | B1 | | 9/2005 | Sokolowski | |
| 6,988,998 | B1 | | 1/2006 | Santaana-Dela Rosa | |
| 7,100,212 | B2 | * | 9/2006 | Jaeger | 2/161.1 |
| 7,103,918 | B2 | * | 9/2006 | Isom et al. | 2/159 |
| 7,537,577 | B2 | * | 5/2009 | Phelan et al. | 602/21 |
| 7,895,670 | B2 | * | 3/2011 | Kleinert | 2/161.1 |
| 2003/0051285 | A1 | | 3/2003 | Bower | |
| 2004/0025226 | A1 | | 2/2004 | Jaeger | |
| 2004/0049141 | A1 | | 3/2004 | Slautterback et al. | |

OTHER PUBLICATIONS

Pictures and description of glove (1) on sale prior to Jul. 27, 2004, (5 pages).

Pictures and description of glove (2) on sale prior to Jul. 27, 2004, (5 pages).

Multiple pages from <http://www.shocktek.com> (22 pages labeled ST-1 thru ST-22 for purposes of IDS); date of first publication unknown, but at least as early as Apr. 27, 2005 for ST-13, at least as early as Jul. 25, 2005 for remaining pages.

* cited by examiner

GLOVE WITH MULTI-ELEMENT DORSAL STIFFENERS

CROSS REFERENCE OF RELATED APPLICATIONS

This non-provisional U.S. patent application is a continuation and claims priority to U.S. patent application Ser. No. 11/189,988, now allowed, which was filed with the U.S. Patent and Trademark Office on Jul. 27, 2005, such prior U.S. patent application being entirely incorporated herein by reference.

TECHNICAL FIELD

At least some embodiments of this invention relate to a glove having stiffening components and usable, e.g., during athletic activities such as weight lifting. In particular, at least some embodiments relate to gloves having stiffening elements affixed to the dorsal region.

BACKGROUND

Gloves have long been used in athletic and other types of activities to protect the hand(s) of the wearer. In many cases, a glove is used to protect the hand from abrasion caused by repeated contact with something being grasped by the user. Padding in the palm and finger regions is sometimes used to help distribute the force caused by such grasping. It is also known to include stiffening elements in a glove. Such stiffening elements, which may be rigid or flexible, can help prevent injury to the wearer. Stiffening elements may also improve the wearer's performance in a particular activity by helping the wearer maintain a desired hand position.

Weight lifting is one type of athletic activity in which gloves can be helpful for all of these reasons. Frequent high-load contact with a metal bar can chafe, blister or otherwise injure or irritate an unprotected hand. Although calluses will typically form after some period of time, many persons seek to avoid developing hardened skin surfaces on their hands. Additional support for the hand is also desirable. When pushing a heavily-weighted bar away from the body, for example, a lifter's hands can be forced backwards (i.e., the back of the hands forced toward the forearms). If the lifter is not careful, excessive motion in this direction may result in hyperextension of the hand. This can cause a lifter to lose his or her grip on the bar. Injury can also result. Such injury could take the form of wrist or hand strain, as well as possible injury from a bar dropped due to a lost grip. To help prevent hand hyperextension, some weight lifting gloves include stiffening elements.

Cost of manufacture is a consideration in the design and construction of gloves. Adding stiffeners requires additional materials and manufacturing steps. Although the incremental cost per glove for additional materials and manufacturing steps may be relatively modest, such costs can become quite substantial during large production runs. Thus, any incremental reduction in cost can potentially have a significant impact.

SUMMARY

In at least some embodiments, the invention includes a glove having at least one non-rigid stiffening batten. The batten includes a pair of arms which are connected by a bridging member, with the arms extending independently from the bridging member. In some embodiments, the batten may be "H" shaped. When the glove is worn, the batten is positioned on the back of the wearer's hand and terminates on a proximal side of the second through fifth fingers. In at least some embodiments, a glove includes two "H" shaped battens. Embodiments of the invention may further include a one-piece protective panel attached to the palmar side of the glove. The protective panel covers portions of the wearing hand palm corresponding to the distal ends of the second through fifth metacarpal bones, as well as palmar side portions of the second through fifth digits corresponding to the second through fifth proximal phalanx bones. Flex notch cut-outs in the protective panel correspond to portions of the palmar region which tend to bunch during gripping of a bar or other object and help prevent discomfort during such gripping.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE PREFERRED EMBODIMENTS

Figure 1:
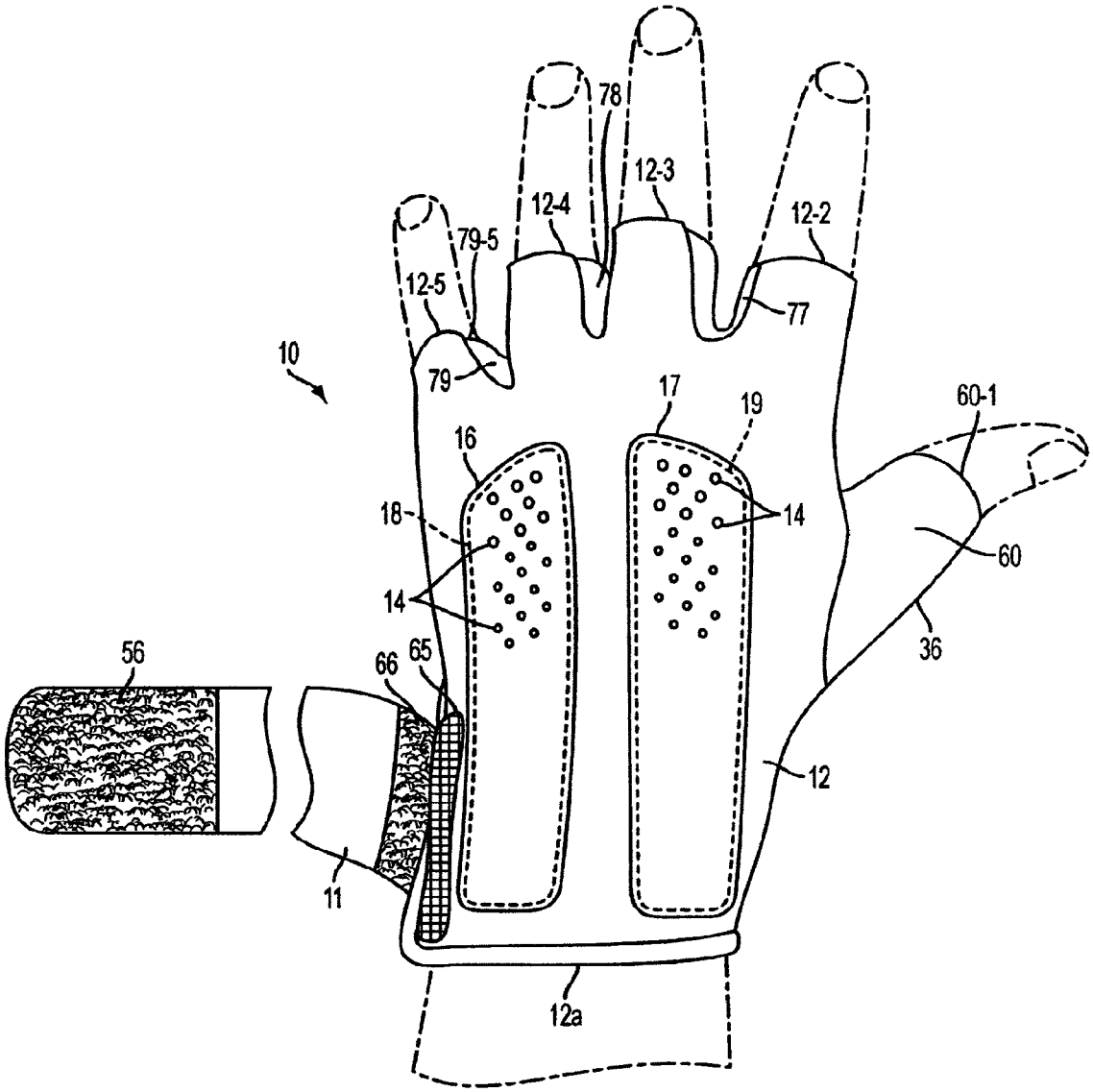
FIG. 1 is a dorsal view of a glove according to at least some embodiments of the invention.

Throughout this specification (including the claims), various glove components are described using anatomical terms for corresponding hand regions of a glove wearer. For example, "palmar" and "dorsal" refer to the palm and back sides of the hand, respectively. "Digits" include the thumb and fingers, and are numbered 1 (the thumb, also referred to as the first digit) through 5 (the little finger, also called the fifth digit). "Distal" refers to a direction going toward the ends of the fingertips. The distal end (or side) of a particular glove feature refers to the end (or side) of that feature which is closer to the wearer's fingertip(s) when the glove is worn. Similarly, "proximal" refers to a direction going toward the forearm. The proximal end (or side) side of a particular glove feature refers to the end (or side) of that feature which is closer to the wearer's forearm when the glove is worn. "Radial" refers to the side of the hand on which the thumb (digit 1) is located. The radial side of a particular glove feature refers to the side of that feature which is closer to the thumb side of the hand when the glove is worn. "Ulnar" refers to the side of the hand on which the little finger (digit 5) is located. The ulnar side of a particular glove feature refers to the side of that feature which is closer to the digit 5 side of the hand when the glove is worn.

Various aspects of gloves are also described by reference to bones of the wearer's hand. For example, the positions of various glove features are described by indicating the bone(s) to which those features may be closest. The names and locations of human hand bones are well known. Several of the drawings include an outline of a hand wearing a glove. Because the location of a particular hand bone can be readily determined from such an outline, a separate drawing juxtaposing human hand bones and a glove is not necessary.

FIGS. 1-7 show a left-handed glove 10 according to at least some embodiments of the invention. Although not shown, a right handed glove is substantially identical, but with mirror-image components arranged so as to fit a right hand of a wearer. Embodiments of the invention include the left or right hand glove individually, as well as a pair of gloves. FIG. 1 shows a dorsal view of glove 10 with wrist strap 11 unfastened. As discussed in more detail below, wrist strap 11 (which is only partially shown in FIGS. 1-3) wraps around glove 10 at the wrist to secure glove 10 in place. As seen in FIG. 1, glove 10 also includes a dorsal panel 12 extending from a proximal edge 12*a* at the wearer's wrist to distal edges 12-2 through 12-5. In at least some embodiments, edge 12-2 is near the wearer's second proximal interphalangeal joint (i.e., the joint between the second proximal and second middle phalanx bones). Similarly, edges 12-3 through 12-5 are respectively near the wearer's third through fifth proximal interphalangeal joints.

Figure 2:
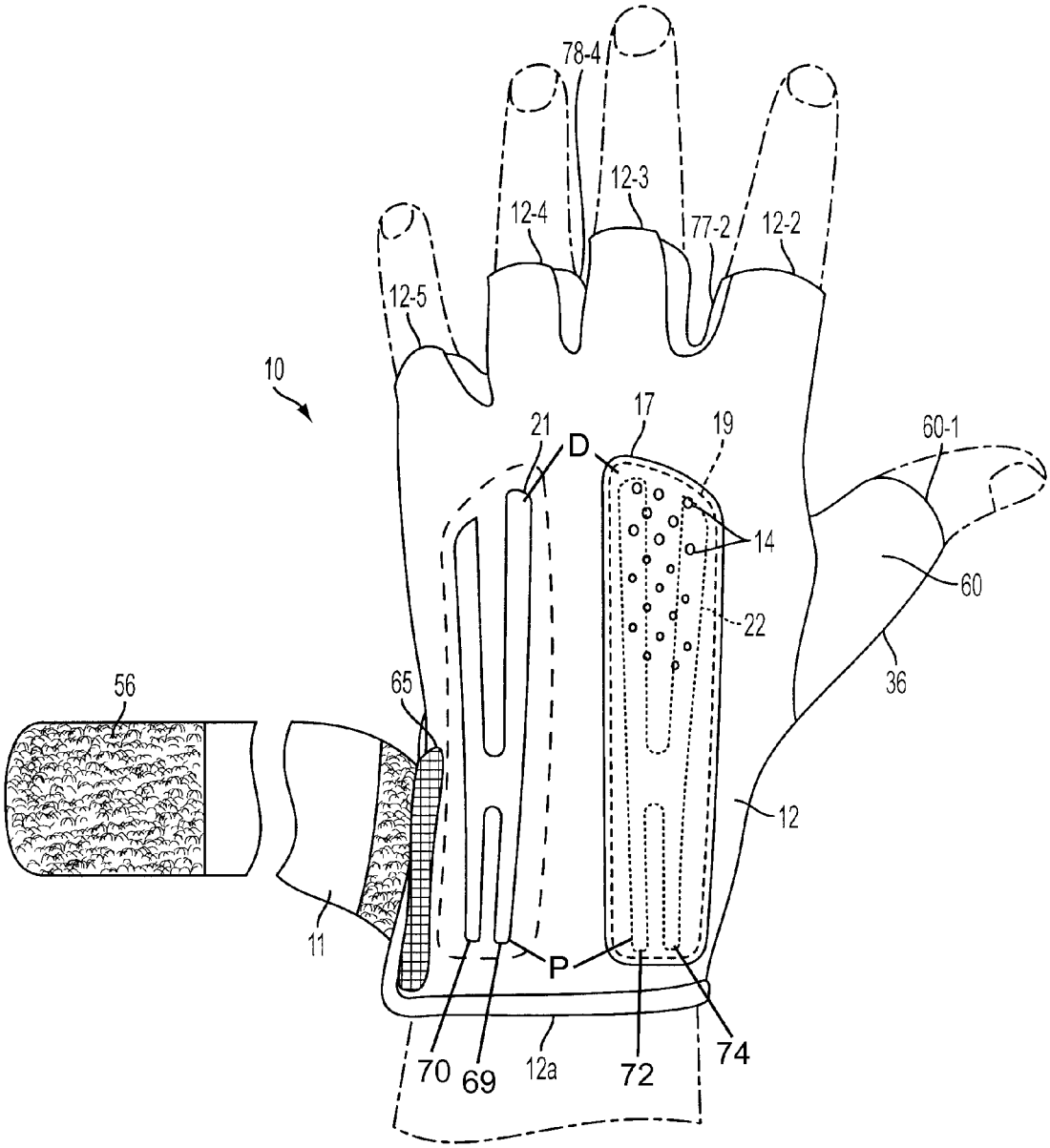
FIG. 2 is a dorsal view of the glove from FIG. 1 and showing the location of stiffening battens.

Attached to dorsal panel 12 are ulnar batten cover 16 and radial batten cover 17. Batten covers 16 and 17 are secured to dorsal panel 12 around their peripheries with stitching 18 and 19. Each batten cover is formed from leather or other suitable material and includes a series of ventilation holes 14 at its distal end. Although not visible in FIG. 1, a stiffening batten is situated between each of covers 16 and 17 and the surface of dorsal panel 12. FIG. 2 is similar to FIG. 1, but with batten cover 16 removed to reveal ulnar batten 21. The position of radial batten 22 under batten cover 17 is shown in FIG. 2 with even broken lines. As seen in FIG. 2, battens 21 and 22 are generally H-shaped and extend from proximal terminal ends P, located in a position near edge 12*a* to distal terminal ends D, located it positions near the distal ends of the wearer's third and fourth metacarpal bones. As explained in more detail below, battens 21 and 22 are formed from a non-rigid resilient material which provides support for the wearer's hand and urges the hand into a proper posture. Batten cover 16 is a mirror image of batten cover 17. Batten 21 comprises first arm 70 and second arm 69. Batten 22 comprises third arm 72 and fourth arm 74. Battens 21 and 22 are identical, but are oriented so that the longest side of each is near the wearer's hand centerline.

Figure 3:
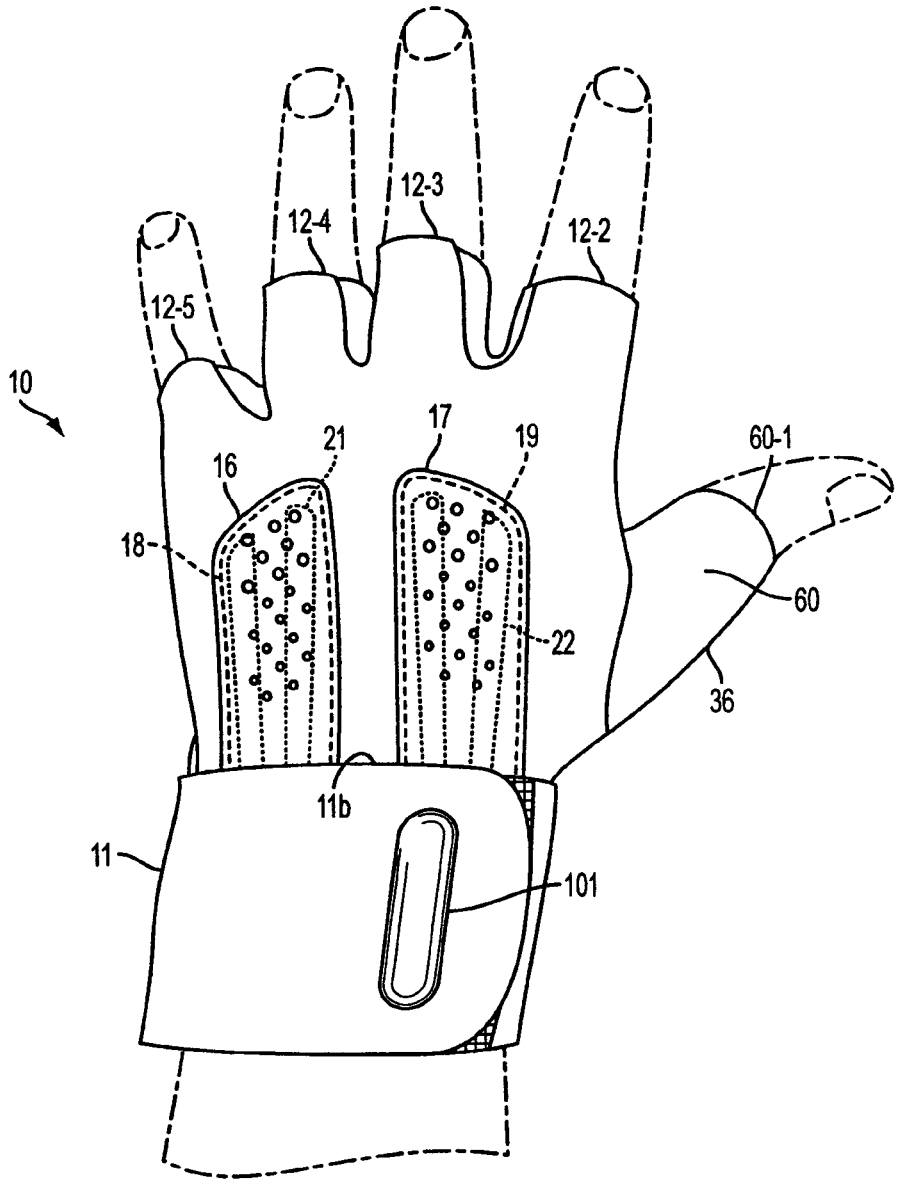
FIG. 3 is a dorsal view of the glove from FIG. 1 after a wrist strap is fastened.

FIG. 3 is also a dorsal view of glove 10, but with wrist strap 11 secured in place. The locations of battens 21 and 22 are shown with even broken lines. In this configuration, battens 21 and 22 are held firmly against the wearer's wrist. The portions of battens 21 and 22 extending past the distal edge 11*b* of strap 11 then serve to resist bending motion of the hand at the wrist. As the hand is bent back in the dorsal direction, the portions of battens 21 and 22 extending past strap 11 apply increasing pressure to the back of the wearer's hand. This provides an increasing tactile cue to the wearer that his or her hand position may be improper. Although not shown in the drawings, strap 11 is sufficiently long to wrap around a wearer's wrist approximately 1 and ½ times.

Figure 4:
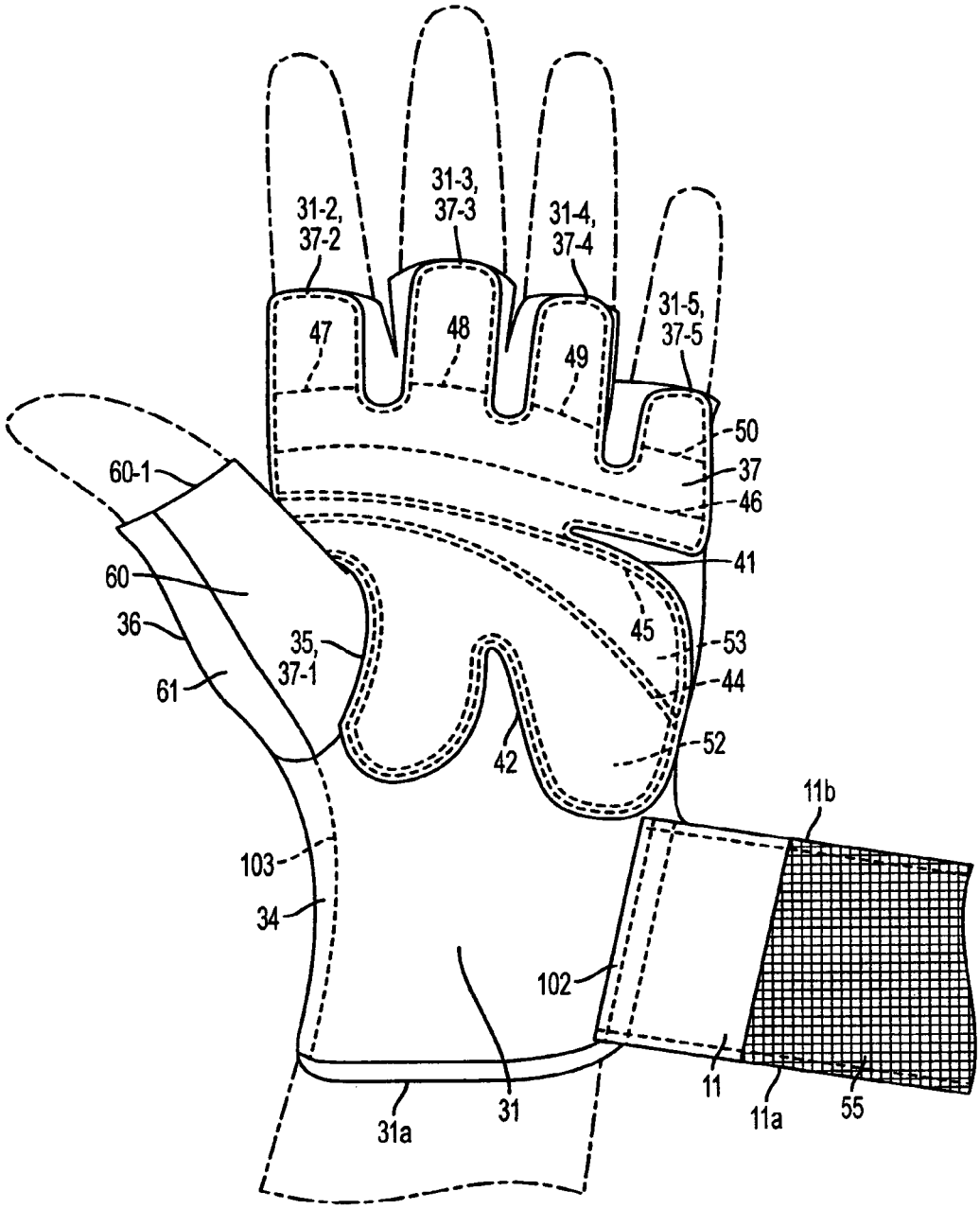
FIG. 4 is a palmar view of the glove from FIG. 1.

FIG. 4 is a palmar view of glove 10 with wrist strap 11 unfastened. Partially visible in FIG. 4 is a palmar panel 31. Similar to dorsal panel 12, palmar panel 31 extends from a proximal edge 31*a* near the wearer's wrist to distal edges 31-2 through 31-5. In at least some embodiments, distal edges 31-2 through 31-5 are respectively located near the wearer's second through fifth proximal interphalangeal joints. The proximal radial side portion of palmar panel 31 includes a radial side strip 34, the formation of which is described below. Palmar panel 31 also includes a cutout 35 (seen more clearly in FIG. 9) to which articulated first digit cover 36 is attached. As discussed below, first digit cover 36 is formed from a gripping portion 60 and vented portion 61, each of which is attached to palmar panel 31 at cut-out 35. Gripping portion 60 and vented portion 61 are sized so that distal edge 60-1 is located near the joint between the wearer's first proximal and distal phalanx bones.

Attached to the outer surface of palmar panel 31 is a protective panel 37. In at least some embodiments, protective panel 37 is formed from a sturdier material (e.g., natural or synthetic leather, synthetic suede) than is used for palmar panel 31 and dorsal panel 12. Protective panel 37 is located in a region of the wearer's hand which is used to grasp a bar or other object during weight lifting, and protects the wearer's hand from abrasion, etc. Because the sturdier material of protective panel 37 is less breathable than the materials used for other portions of glove 10, protective panel 37 does not extend to edge 31*a* of palmar panel 31.

Two flex notch cut-outs 41 and 42 are formed in protective panel 37. These notches are located in regions which would potentially bunch during certain gripping movements by the wearer. Such bunching would potentially cause excess glove material to be situated between the wearer's palm and the object being gripped, which could in turn cause discomfort. Such bunching could also cause the wearer's grip to have an improper "feel" and be distracting to the wearer. Flex notch cut-out 42 is located on the lower portion of protective panel 37 at approximately the center of the wearer's palmar region. Flex notch cut-out 41 is located on the ulnar side of protective panel 37 just below the distal end of the wearer's fifth metacarpal bone, and extending approximately to the fourth metacarpal bone.

Protective panel 37 is stitched around its periphery to palmar panel 31. Protective panel 37 also includes stitched crease lines 44 through 50. In addition to helping secure protective panel 37 to palmar panel 31, these crease lines generally correspond to fold lines of the wearer's hand during various gripping motions. Crease lines 44-50 urge protective panel 37 to fold at those same locations, further minimizing bunching between the wearer's hand and a gripped object. Crease lines 44 and 45 also divide protective panel into sections 52 and 53. In at least some embodiments, additional padding is placed between protective panel 37 and palmar panel 31 in sections 52 and 53. In at least some embodiments (and as shown in FIG. 4 for stitch lines 44 and 45), one or more crease lines may be double-stitched.

A leading edge 102 of wrist strap 11 is attached to palmar panel 31 at the proximal ulnar edge. A patch 55 of hook material is attached to the side of strap 11 and faces outward when strap 11 is wrapped around the wearer's wrist. A mating patch 56 of loop material (see FIGS. 1-3) is attached to the inside trailing end of strap 11, and secures wrist strap 11 in place.

Figure 5:
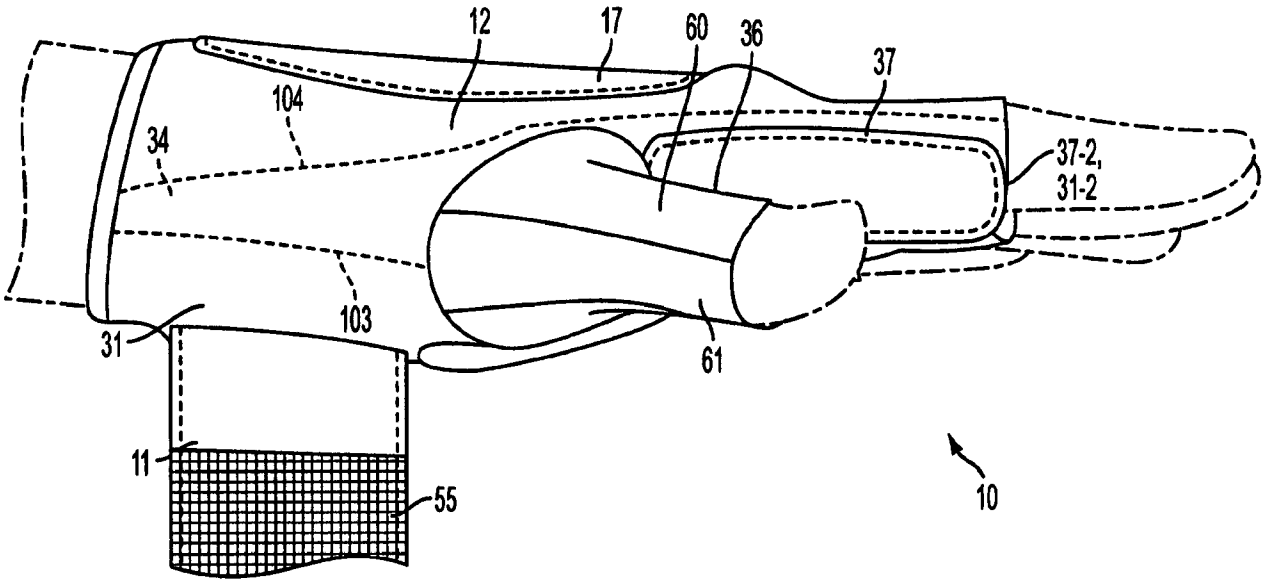
FIG. 5 is a radial side view of the glove from FIG. 1.
Figure 6:
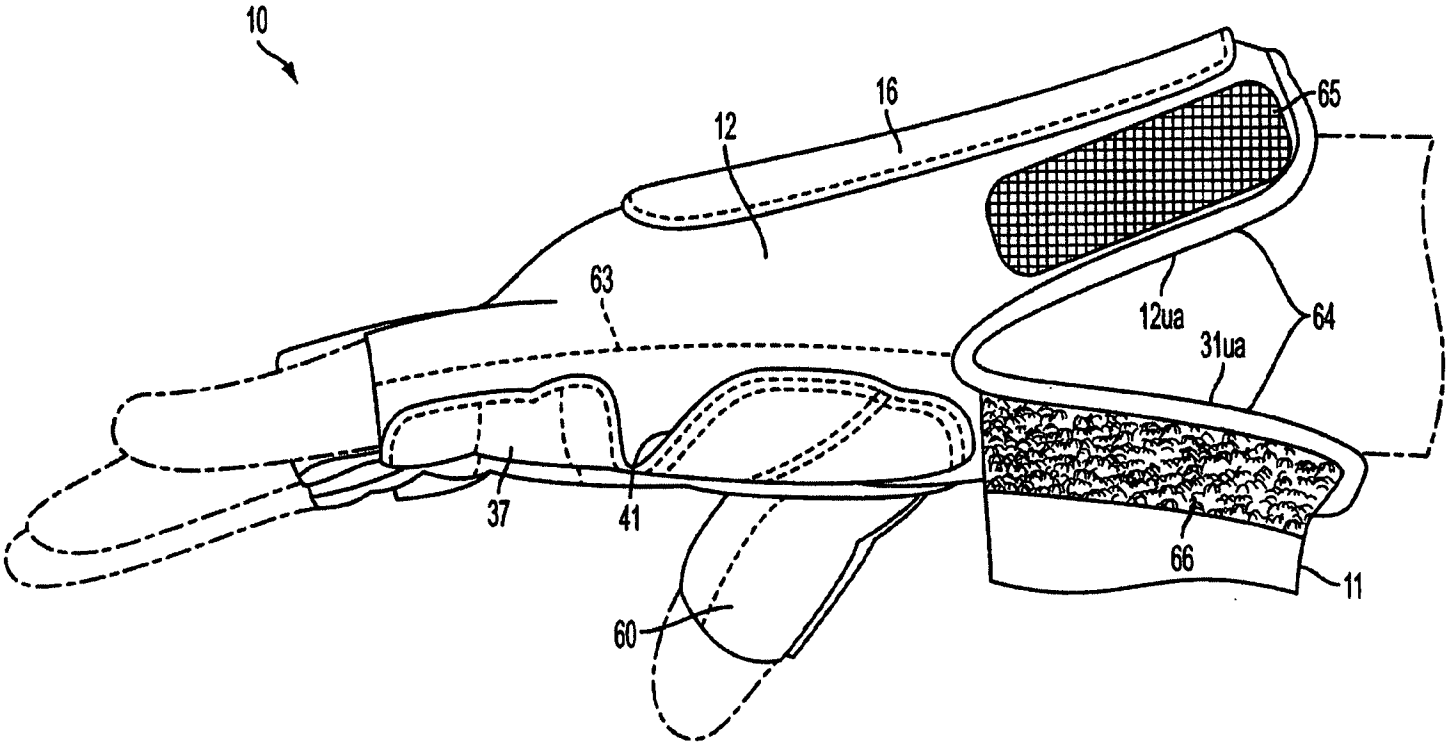
FIG. 6 is an ulnar side view of the glove from FIG. 1.

FIG. 5 is a radial side view of glove 10 with wrist strap 11 unfastened, and shows additional construction details. Radial strip 34 of palmar panel 31 is attached to another portion of palmar panel 31 along seam 103. The radial edges of palmar panel 31 and dorsal panel 12 are joined along a seam 104. FIG. 6 is an ulnar side view of glove 10 with wrist strap 11 unfastened, and with a portion of wrist strap 11 removed for clarity. Seam 63 attaches portions of the ulnar edges of palmar panel 31 and dorsal panel 12 along roughly 60% of the length of glove 10. Edges 31*ua* and 12*ua* are unattached and form a V-shaped opening 64. Opening 64, when wrist strap 11 is unfastened, allows glove 10 to be more easily donned or removed. A patch 65 of hook material is located adjacent to the edge of opening 64 on the outer face of dorsal panel 12. A mating patch 66 of loop material is located near the base of wrist strap 11, and serves to close opening 64 when strap 11 is secured around the wearer's wrist.

Figure 7:
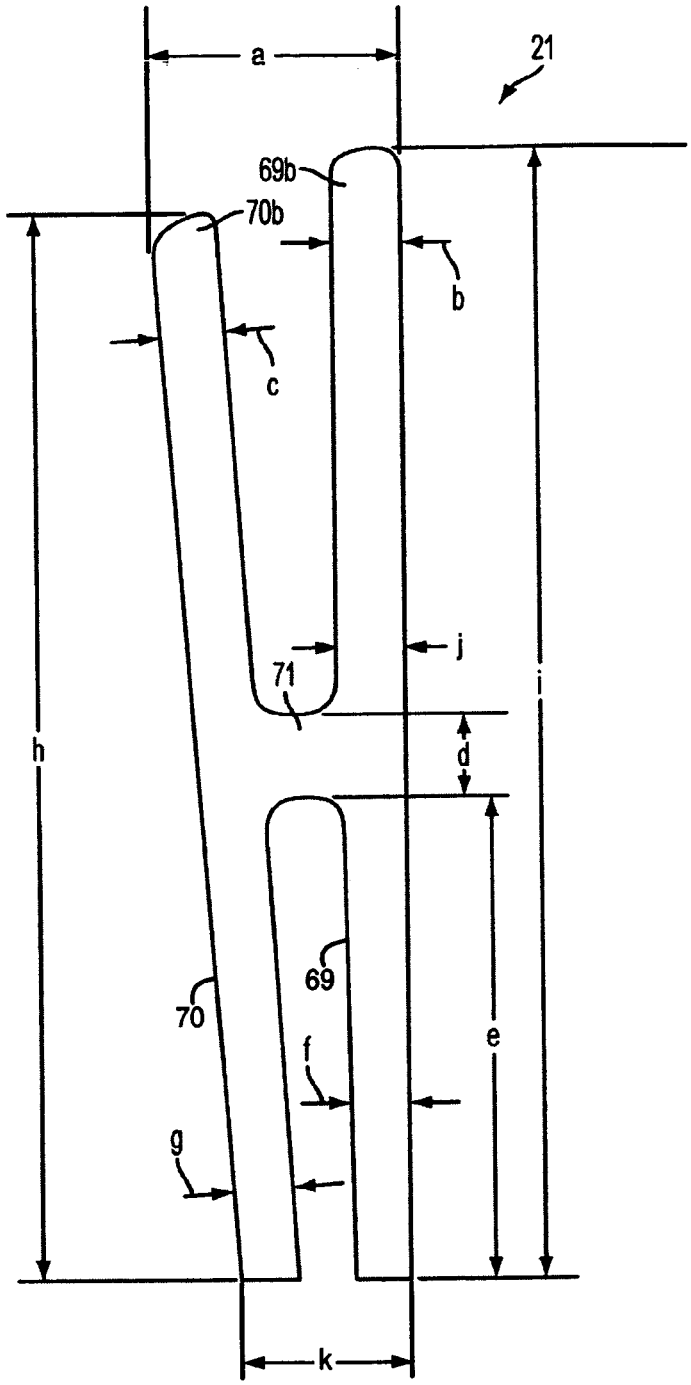
FIG. 7 shows, prior to assembly, a stiffening batten of the glove of FIGS. 1-6.

FIGS. 7 through 13 show individual components of glove 10 prior to assembly. FIG. 7 shows ulnar batten 21. As previously indicated, ulnar batten 21 and radial batten 22 are identical, but are oriented differently when glove 10 is constructed. Batten 21 is roughly H-shaped, and has two longitudinal arms 69 and 70 connected by an integral bridge 71. As used herein, components are "integral" when they are formed or joined together as a single piece. Arm 69 is slightly longer than arm 70, with spacing between arms 69 and 70 at one end of batten 21 being slightly wider that the spacing between the arms at the other end of batten 21. Distal ends 69*b* and 70*b* of arms 69 and 70 may be rounded so as not to dig into the back of a wearer's hand. In at least some embodiments, batten 21 is 1.6 mm thick throughout. Although the dimensions of batten 21 can vary, exemplary dimensions are given in Table 1.

TABLE 1

| Dimension | Value (variation) |
|---|---|
| a | 21.6 mm (20.5 mm-22.7 mm) |
| b | 5.9 mm (5.6 mm-6.2 mm) |
| c | 6.1 mm (5.8 mm-6.4 mm) |
| d | 16.7 mm (15.9 mm-17.5 mm) |
| e | 29.0 mm (27.6 mm-30.5 mm) |
| f | 6.2 mm (5.9 mm-6.5 mm) |
| g | 6.4 mm (6.1 mm-6.7 mm) |
| h | 95 mm (90.3 mm-99.8 mm) |
| i | 100 mm (95 mm-105 mm) |
| j | 7.0 mm (6.7 mm-7.4 mm) |
| k | 15.0 mm (14.3 mm-15.8 mm) |

Although not drawn to scale, FIG. 7 does show how, in at least some embodiments, the longer edges of arms 69 and 70 (i.e., an edge from tit-to-tip or from bridge-to-tip) are generally straight. The widths of arms 69 and 70 may also taper slightly going in the direction from bridge 71 to the tips of the arms. As but one example of alternate embodiments in which some or all of the dimensions of battens 21 and 22 may be varied, parentheticals in Table 1 show variations in dimensions a through k of approximately five percent.

The exemplary dimensions in Table 1 are for a glove size "large." In at least some embodiments, batten dimensions are scaled upward or downward for other sizes so that the ends of the battens will have the same positions relative to wearer's hand. In certain embodiments, battens 21 and 22 are formed from a semi-rigid polymer such as polypropylene. Such material allows battens 21 and 22 to provide stiffening but also be non-rigid. In other words, battens 21 and 22 provide some resistance to dorsal bending of the hand at the wrist. However, battens 21 and 22 deflect and do not prevent the hand from bending backwards if a sufficient amount of force is applied. Instead, battens 21 and 22 urge the wearer's hand into proper position by applying force to the backs of the hands as the hands are moved at the wrist in the dorsal direction. Because the battens are non-rigid, however, the pressure does not become uncomfortable. Moreover, certain exercises may require hyperextension of the hands (although perhaps using less weight than might be used during other types of exercises). Non-rigid battens allow such desired hyperextension.

Figure 8:
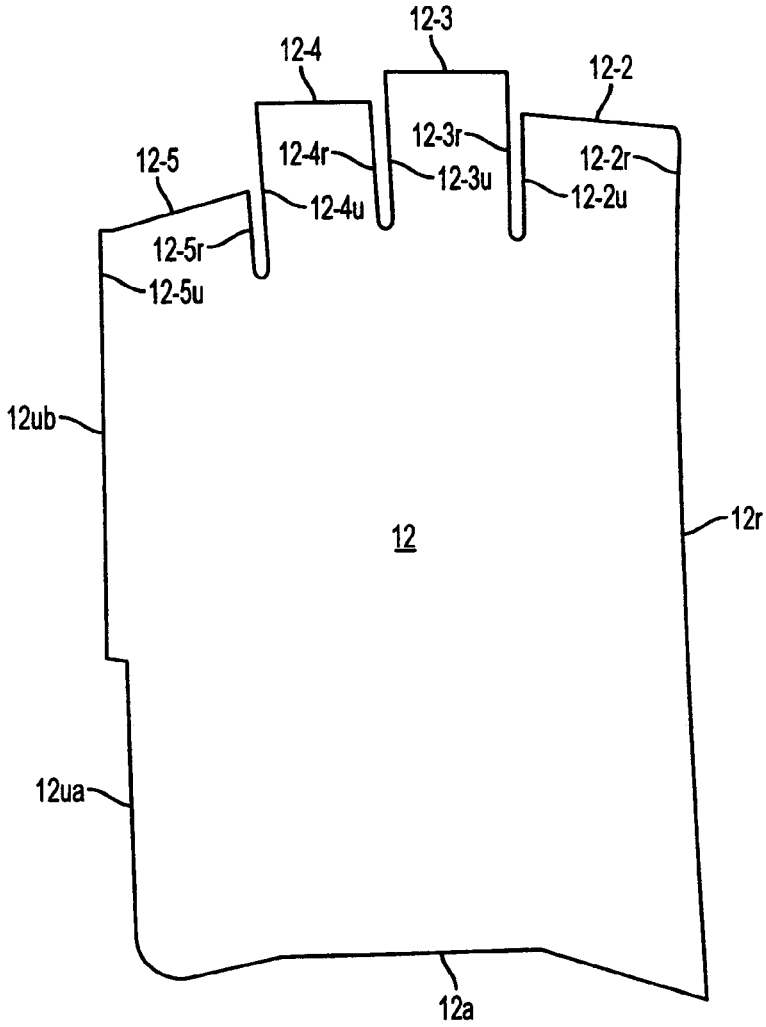
FIG. 8 shows, prior to assembly, an inside surface view of the dorsal panel of the glove of FIGS. 1-6.

FIG. 8 shows the outside surface of dorsal panel 12 prior to assembly of glove 10. In other words, FIG. 8 shows the side of dorsal panel 12 which will face away from the wearer's hand when assembled glove 10 is worn. Various edges of dorsal panel 12 are labeled in FIG. 12, and will be subsequently referenced in connection with assembly of glove 10. Dorsal panel 12 includes a proximal ulnar edge 12*ua*, a distal ulnar edge 12*ub* and a radial edge 12*r*. Also labeled in FIG. 8 are distal edges 12-2 through 12-5 which, as seen in FIG. 1, are the distal edges of the dorsal panel 12 regions covering the bases of the wearer's second through fifth digits. The radial and ulnar side edges adjacent each of these distal edges 12-2 through 12-5 is respectively labeled with an "r" or "u" suffix. For example, the side edges adjacent distal edge 12-2 are labeled 12-2*r* and 12-2*u*.

In at least some embodiments, dorsal panel 12 and palmar panel 31 are formed from a lightweight material which is "breathable." In other words, the material of dorsal panel 12 (and of palmar panel 31) allows air from outside glove 10 to reach the wearer's hand (and vice versa). This can help keep the wearer's hand cool and dry by allowing perspiration to evaporate. In some embodiments, and so as to draw perspiration away from a wearer's skin and toward the outer surface of the glove, dorsal panel 12 (and palmar panel 31) is constructed from a breathable, moisture-wicking fabric such as the material sold under the name DRI-FIT by Nike, Inc. of Beaverton, Oreg.

Figure 9:
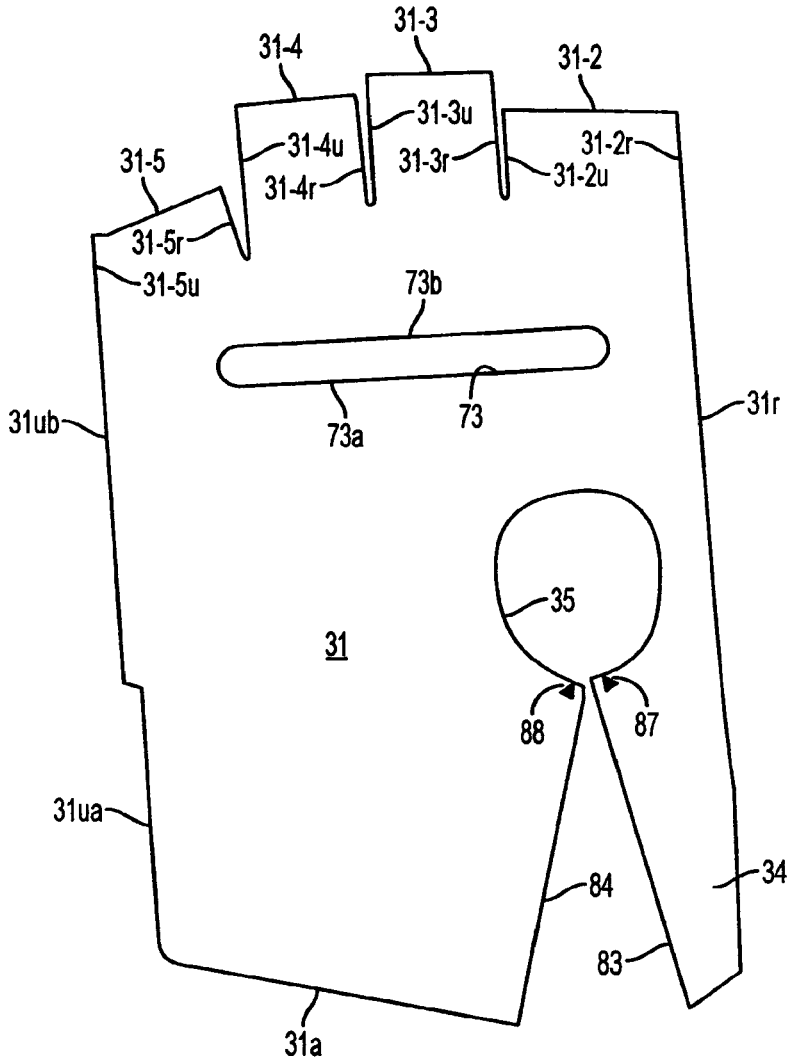
FIG. 9 shows, prior to assembly, an inside surface view of the palmar panel of the glove of FIGS. 1-6.

FIG. 9 shows the inside surface of palmar panel 31 prior to assembly of glove 10. In other words, FIG. 9 shows the surface of palmar panel 31 which will face the wearer's palm when assembled 10 glove is worn. As indicated above, palmar panel 31 is in at least some embodiments formed from the same material as is used to form dorsal panel 12. Various components of palmar panel 31 are also labeled in FIG. 9 for ease of reference during subsequent description of assembling glove 10. For example, and similar to dorsal panel 12, palmar panel 31 includes a proximal ulnar edge 31*ua*, a distal ulnar edge 31*ub* and a radial edge 31*r*. The edges adjacent distal edges 31-2 through 31-5 are also labeled using the same convention as is used for dorsal panel 12.

Palmar panel 31 also includes a series of cutouts. Cross-palm cut-out 73 is used to shape the surface of palmar panel 31, as discussed below. Cut-out 73 includes a distal edge 73*b* and a proximal edge 73*a*. Thumb cut-out 35 (previously mentioned in connection with FIG. 4) corresponds to first digit cover 36. Two markers 87 and 88 are also included in FIG. 9 on the edge of cut-out 35. These markers are provided for purposes of explanation and would not necessarily appear on an actual glove component. The significance of these markers is explained below in connection with attachment of first digit cover 36. Proximally located from thumb cutout 35 is a third cutout having edges 83 and 84 (the significance of which is also explained below). In at least some embodiments, and as seen in FIG. 9, cut-out 35 and the cut-out having edges 83 and 84 are actually parts of a single cut-out.

Figure 10:
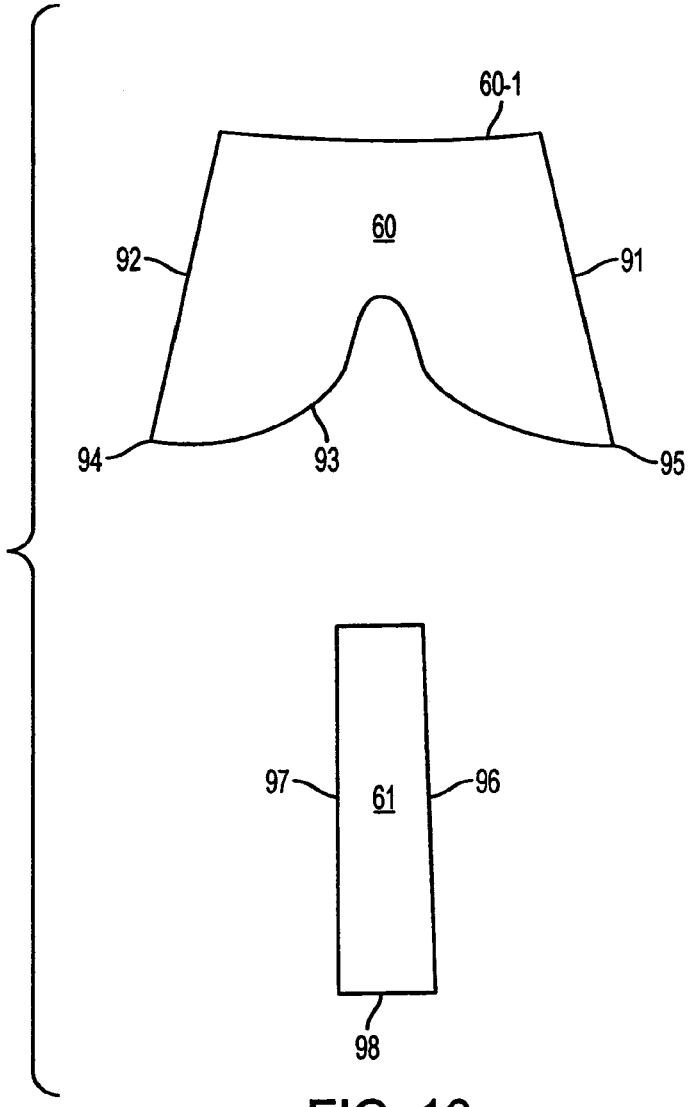
FIG. 10 shows, prior to assembly, components of the first digit cover of the glove of FIGS. 1-6.

FIG. 10 shows gripping portion 60 and vented portion 61 of first digit cover 36 prior to assembly. Gripping portion 60, which in some embodiments is made from the same material used for protective panel 37 (e.g., natural or synthetic suede, etc.), includes edges 91, 60-1, 92 and 93. Edges 91 and 93 meet at vertex 95, and edges 92 and 93 meet at vertex 94. Vented portion 61, which can be cut from the same material used for dorsal panel 12 and palmar panel 31, includes edges 96, 97, and 98.

Figure 11:
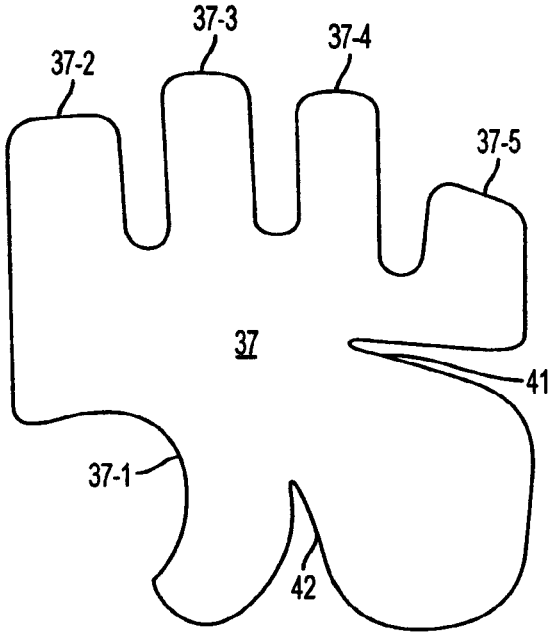
FIG. 11 shows, prior to assembly, a palm protection panel of the glove of FIGS. 1-6.

FIG. 11 shows protective panel 37 prior to assembly of glove 10. Labeled in FIG. 11 are distal edges 37-2 through 37-5. As seen in FIG. 4, these edges respectively correspond to palmar panel edges 31-2 through 31-5 when protective panel 37 is attached to palmar panel 31. First digit edge 37-1 generally corresponds to cut-out 35 of palmar panel 31.

Figure 12:
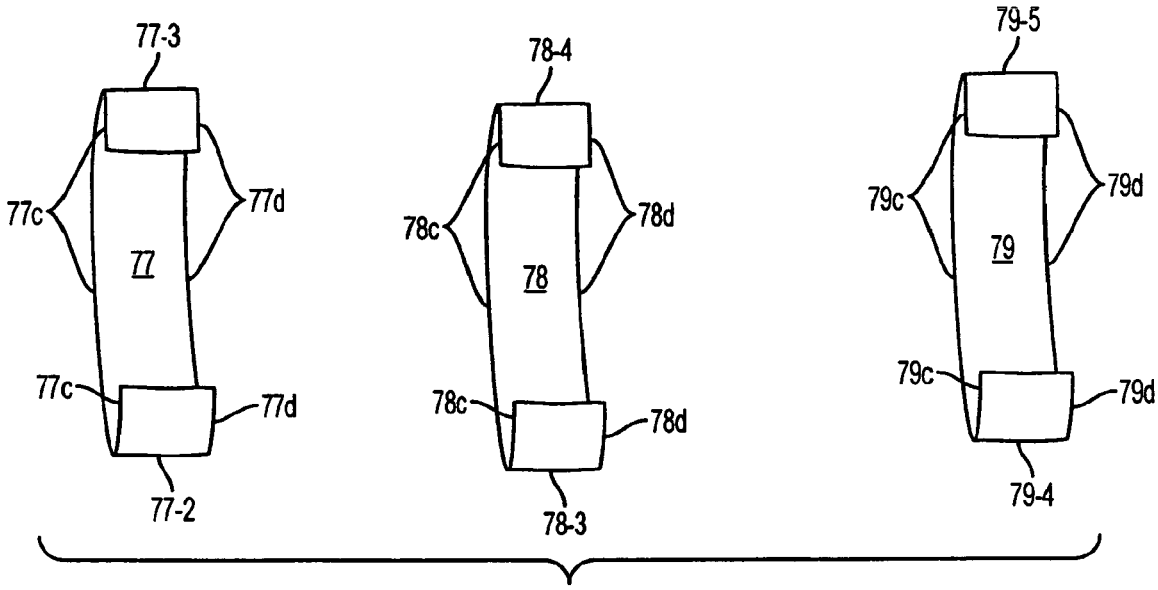
FIG. 12 shows, prior to assembly, inter-digital gussets of the glove of FIGS. 1-6.

FIG. 12 shows gussets 77, 78 and 79. Gusset 77, which is only partially visible in FIGS. 1-3, connects dorsal panel 12 and palmar panel 31 and forms the region between digits 2 and 3. In at least some embodiments, gussets 77, 78 and 79 are formed from strips of material such as a nylon/spandex blend (e.g., 85% nylon/15% spandex, 44"×190~200 g/yd), with the longitudinal ends folded over as shown. An edge 77-3 is formed at one folded-over end, and an edge 77-2 formed at the other folded over end. Edge 77*c* (which includes edges of the folded-over portions at the ends) connects edges 77-2 and 77-3 on one side of gusset 77, while edge 77*d* (which also includes edges of the folded-over portions at the ends) connects edges 77-2 and 77-3 on the other side. The significance of edges 77-2, 77-3, 77*c* and 77-*d* is explained below. Gussets 78 and 77 are similarly formed. Gusset 78 will form the regions between digits 3 and 4, and includes edges 78-3, 78-4, 78*c* and 78*d*. Gusset 79 will form the regions between digits 4 and 5, and includes edges 79-4, 79-5, 79*c* and 79*d*.

Figure 13:
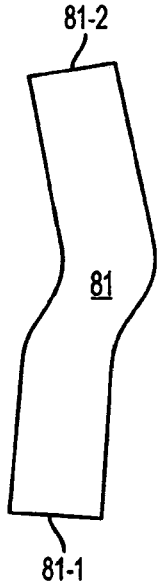
FIG. 13 shows, prior to assembly, a first/second digit reinforcing panel of the glove of FIGS. 1-6.

FIG. 13 shows first-second digit reinforcement 81. Reinforcement 81, which may be formed from the same material used for protective panel 37 and gripping portion 60, will be attached to insides surfaces of palmar panel 12 and gripping portion 60 to reinforce the first and second digits and the region therebetween. Reinforcement panel 81 includes edges 81-1 and 81-2, the significance of which is explained below.

The ordering of steps for assembling glove 10 can be varied. In at least some embodiments, battens 21 and 22 and covers 16 and 17 are first placed in their proper positions on the outer surface of dorsal panel 12. Stitching 18 and 19 (see FIG. 1) is then applied to secure covers 16 and 17 (and thus, battens 21 and 22) in place. Next, the opposing edges 73*a* and 73*b* of cross-palm cut-out 73 (FIG. 9) are sewn together. In this manner, palmar panel 31 will more closely conform to the contour of the wearer's palm. Next, edges 83 and 84 (FIG. 9) are stitched together to form seam 103 (see FIG. 5). In this manner, radial strip 34 will more closely conform to the radial edge of the wearer's hand.

Protective panel 37 is then placed in the proper position on the outer surface of palmar panel 31. In particular, edge 37-1 is located near the edge of cut-out 35, and edges 37-2 through 37-5 are generally aligned with edges 31-2 through 31-5, respectively, of palmar panel 31. If desired, padding is also placed between protective panel 37 and palmar panel 31 in the areas which will become regions 52 and 53 (FIG. 4). In at least some embodiments, 100% polyurethane foam (2 mm×160 cm, total weight 60 g/m) is used for such padding. Protective panel 37 is then sewn in place, and crease line stitches 44 through 50 are added.

Gripping panel 60 of first digit cover 36 is then attached. Referring to FIGS. 9 and 10, gripping panel 60 is rolled by pulling edges 91 and 92 toward each other. The end of rolled panel 60 having edge 60-1 is then pushed through cut-out 35 from the inside surface of palmar panel 31 until vertices 94 and 95 correspond to the points labeled with markers 88 and 87, and edge 93 corresponds to the larger portion of the cut-out 35 edge between markers 88 and 87. Panel 60 is then stitched to panel 31 along the length of edge 93. Gripping panel 60 is then pulled back through cut-out 35 so that it extends outward from the inside surface of palmar panel 31 in an "inside-out" configuration. In other words, panel 60 would be extending out of the page if shown in FIG. 9.

Reinforcing panel 81 is then sewn in place along its periphery so that edge 81-2 (FIG. 12) generally aligns with edge 31-2 (FIG. 9), and so that edge 81-1 generally aligns with edge 60-1 of inside-out panel 60. Next, edge 97 of vented panel 61 is sewn to edge 92 of (inside out) gripping panel 60, while edge 96 of vented panel 61 is sewn to edge 91 of gripping panel 60. Edge 98 of vented panel 61 is then sewn to the smaller portion of the cut-out 35 edge between markers 88 and 87.

Assembly of glove 10 then continues in an inside-out manner. In particular, the outer surfaces of dorsal panel 12 and palmar panel 31 are placed into contact and edges 12*r* and 31*r* are sewn together to form seam 104. Edges 12*ub* and 31*ub* are similarly sewn together to form seam 63. In at least some embodiments, glove 10 is constructed (and panels 12 and 31 sewn together) so that the finger portions of glove 10 will have a pre-curve of approximately 25 degrees. In other words, glove 10 is constructed so that the partial coverings for the second through fifth digits naturally bend toward the palmar region, with the angle of the second through fifth proximal phalanx bones to the second through fifth metacarpals being 25 degrees (measured from the dorsal side).

Gusset 77 is then attached between panels 12 and 31 so as to form the region between digits 2 and 3. Specifically, gusset 77 is bent so that the folded over ends are facing one another, and is positioned so that edge 77*c* aligns with the portion of the edge of palmar panel 31 corresponding to the space between digits 2 and 3 (i.e., from the ulnar end of edge 31-2 to the radial end of edge 31-3). Edge 77*c* is then stitched in place. Edge 77*d* is then aligned with the portion of the edge of dorsal panel 12 corresponding to the space between digits 2 and 3 (i.e., from the ulnar end of edge 12-2 to the radial end of edge 12-3), and stitched in place. At this point, edge 77-2 connects the ulnar ends of edges 12-2 and 31-2, while edge 77-3 connects the radial ends of edges 12-3 and 31-3.

A similar procedure is followed for gussets 78 and 79. Specifically, gusset 78 is bent so that its folded over ends face one another. Edge 78*c* is then stitched to the portion of the panel 31 edge between the ulnar end of edge 31-3 and the radial end of edge 31-4; edge 78*d* is stitched to the portion of the panel 12 edge between the ulnar end of edge 12-3 and the radial end of edge 12-4. Edge 78-4 then connects edges 12-4 and 31-4 and edge 78-3 connects edges 12-3 and 31-3. Similarly, gusset 79 is bent so that its folded over ends face one another. Edge 79*c* is stitched to the portion of the panel 31 edge between the ulnar end of edge 31-4 and the radial end of edge 31-5, and edge 79*d* is stitched to the portion of the panel 12 edge between the ulnar end of edge 12-4 and the radial end of edge 12-5. Edge 79-5 then connects edges 12-5 and 31-5 and edge 79-4 connects edges 12-4 and 31-4.

At this stage, the assembled portions of glove 10 can be turned right-side out. The folded over ends of gussets 77, 78 and 79 are now inside glove 10. Strap 11 is then attached to the lower ulnar edge of palmar panel 31 to complete glove 10. The details of fabricating strap 11 are not included herein, but would be understood by persons skilled in the art. In some embodiments, and as seen in FIG. 3, strap 11 includes a raised ridge 101 near the edge of the trailing end. This raised ridge can be used for inclusion of a logo or other brand marking and/or for decorative purposes. Ridge 101 has other functional significance, however. Specifically, ridge 101 provides a mechanism by which a wearer of glove 10 can more securely grip the end of strap 11 during fastening or unfastening. This is useful when, e.g., a wearer's hands may be slippery because of perspiration. In at least some embodiments, ridge 101 is formed from urethane.

Exposed edges of glove 10 may then receive extra stitching or otherwise be finished in an appropriate manner so as to avoid fraying, etc. In some cases (e.g., along proximal edges 12*a*, 12*ua*, 31*a* and 31*ua*), an additional strip of material may be placed over the raw edge and sewn in place.

As can be appreciated from the drawings and the preceding description, embodiments of the invention offer numerous advantages. Because the number of stiffening elements is limited, assembly time is reduced. However, the limited number of stiffening elements still provides many of the desirable features of gloves having additional stiffening elements. In particular, distributing numerous independent narrow stiffening elements across the back of the hand can be more comfortable than a single wide stiffening element. Although a single wide stiffening element can help the wearer prevent undesirable hyperextension, it also resists various cross-hand movements (e.g., movement of the first digit towards the fifth digit). This can be distracting and/or uncomfortable. Multiple narrow stiffening elements provide less resistance to cross-hand movement. The above-described battens offer the advantages of a single wide stiffener (fewer pieces to assemble) and of multiple narrow stiffeners (less resistance to cross-hand movement).

The above described protective panel similarly allows reduction of manufacturing costs. Because that protective panel is a single piece, it is not necessary to arrange and attach multiple protective panels on the digits and palmar region. In some existing gloves, excess bunching of a glove in a palmar region has been avoided by placing separate protective panels such that their edges generally correspond with fold lines of the hand. However, the flex notches and crease lines of the above described protective panel offer these same functions using a single piece.

Figure 14:
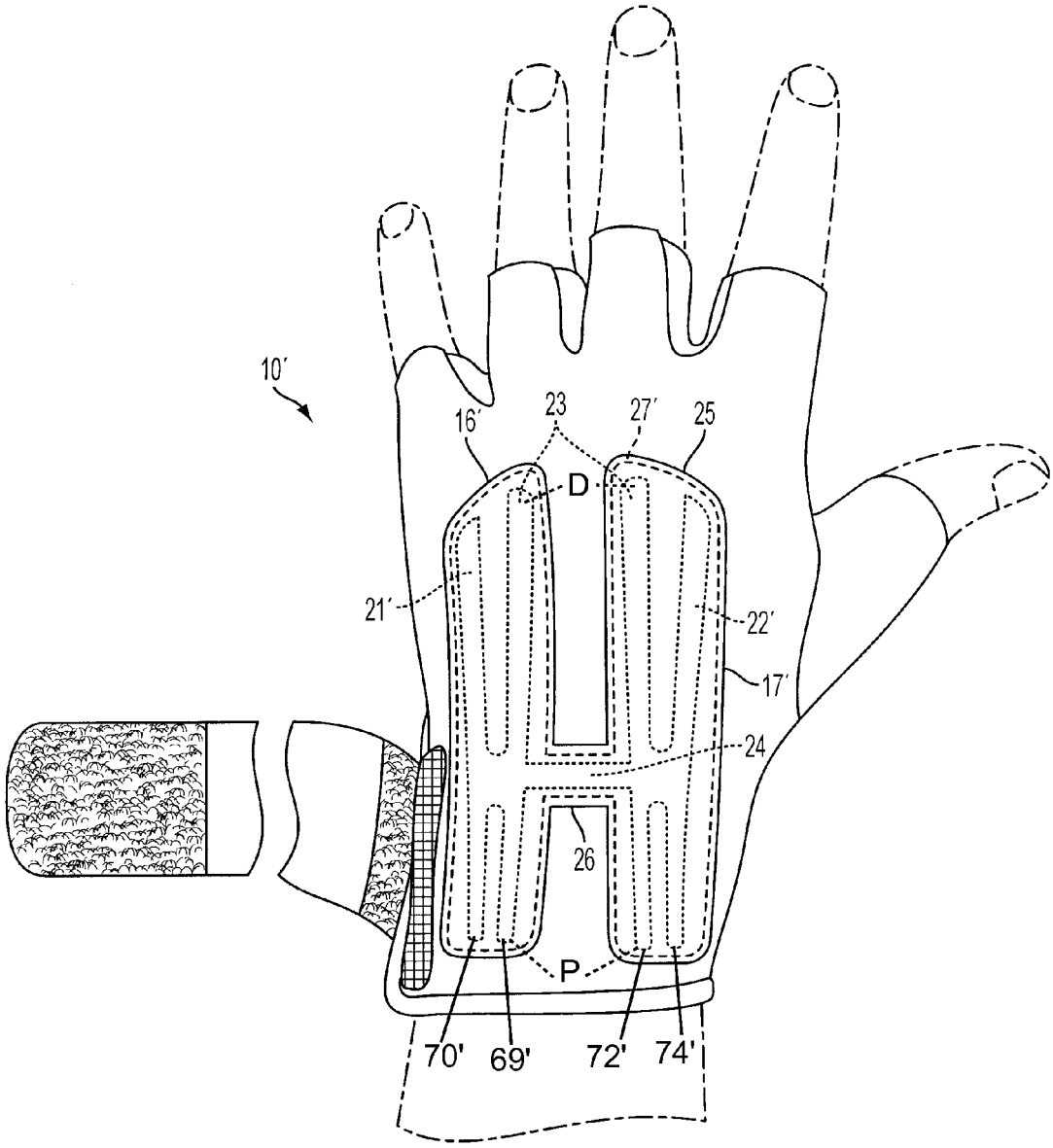
FIG. 14 shows a dorsal view of a glove according to another embodiment of the invention.

FIG. 14 shows a glove 10' according to another embodiment of the invention. As seen in FIG. 14, glove 10' includes a single batten 23. Batten 23 includes an ulnar portion 21' which is similar to batten 21 (FIGS. 1-3, 7) and a radial portion 22' which is similar to batten 22. Ulnar portion 21' comprises first arm 70' and second arm 69'. Ulnar portion 22' comprises third arm 72' and fourth arm 74'. Unlike the embodiment shown in FIGS. 1-3, however, portions 21' and 22' are joined by a bridge 24. As also seen in FIG. 14, glove 10' includes a single batten cover 25 having ulnar and radial portions 16' and 17' similar to batten covers 16 and 17 in FIGS. 1-3. Portions 16' and 17' are joined by a connection strip 26 corresponding to bridge 24. Cover 25 (and thus, batten 23) is attached to glove 10' with stitching 27'. As can be readily appreciated from FIG. 14, glove 10' offers many of the same advantages previously discussed in connection with glove 10 of FIGS. 1-3.

Although embodiments of the invention have been described by example of a protective glove intended for wear during weight lifting activities, the invention is not limited to gloves intended for (or usable during) weight lifting. Gloves similar to those described herein could also be used for numerous other activities (e.g., kick boxing, cycling, dancing), with additional features added to support those other activities. Various modifications of the above described gloves are also within the scope of the invention. For example, connection mechanisms other than stitching (e.g., gluing, RF welding, etc.) could be employed. The invention includes these and other modifications.

The invention claimed is:

1. A glove comprising:

a base, the base including one or more panels which cover at least part of a hand when the glove is worn; and a first non-rigid stiffener secured to the base having a first bridge and a first and second longitudinal arm, the first and second arms being generally straight and integral to the first bridge and extending independently therefrom in a distal direction and terminating at a distal terminal end and a proximal direction and terminating at a proximal terminal end, the first stiffener having a first width that tapers in a direction from the distal terminal ends of the first stiffener to the proximal terminal ends of the first stiffener, so that the first width at the distal terminal ends is greater than the first width at the proximal terminal ends;

a second non-rigid stiffener secured to the base having a second bridge and a third and fourth longitudinal arm, the third and fourth arms being generally straight and integral to the second bridge and extending independently therefrom in both a distal direction and terminating at a distal terminal end and a proximal direction and terminating at a proximal terminal end, the second stiffener having a second width that tapers in a direction from the distal terminal ends of the second stiffener to the proximal terminal ends of the second stiffener, so that the second width at the distal terminal ends is greater than the second width at the proximal terminal ends;

the first and second non-rigid stiffeners are identical and placed on the glove in different orientations, where the second arm is longer than the first arm, and when the glove is worn by a wearer, the second arm is adapted to be nearer a centerline of the wearer's hand than the first arm, the third arm is longer than the fourth arm, and when the glove is worn by the wearer, the third arm is adapted to be nearer the centerline of the wearer's hand than the fourth arm;

the stiffeners are positioned on a dorsal side of the base, the stiffeners resist rotation of the wearing hand about its corresponding wrist in a dorsal direction, and each arm of each stiffener extends distally from a wrist of the wearer and is designed to terminate at the distal terminal ends prior to a distal end of at least one of a second through fifth wearing hand metacarpal bones of the wearer.

2. The glove of claim 1, wherein the first stiffener is integrally connected to the second stiffener.

3. The glove of claim 1, further comprising a one-piece protective panel attached to the base, the protective panel having a cut-out formed therein, wherein when the glove is worn, the protective panel is positioned on a palmar side of the base, the cut-out is located on an ulnar side of the protective panel near the distal end of the wearing hand fifth inetacarpal bone, and the cut-out extends in a cross-palm direction toward the wearing hand second metacarpal bone.

4. The glove of claim 3, wherein the protective panel further includes:

portions covering at least parts of the second through fifth wearing hand digits when the glove is worn, and a second cut-out formed therein, the second cut-out lying approximately along the wearing hand centerline when the glove is worn.

5. The glove of claim 1, further including a wrist strap configured to wrap around a wearing hand wrist when the glove is worn, the wrist strap having a leading end attached to the base and a trailing end, the wrist strap further having a raised portion approximately adjacent to an edge of the trailing end, the raised portion being sized and located to assist gripping of the trailing end.

6. The glove of claim 1, wherein the first and second stiffeners are formed from polyurethane and have a thickness of approximately 1.6 millimeters.

7. A glove comprising:

a base, the base including one or more panels which cover at least part of a hand when the glove is worn; and a first non-rigid stiffener secured to the base having a first integral connecting bridge and a first and second longitudinal arm, the first and second longitudinal arms being generally straight and integral to the first bridge and extending independently therefrom in a distal direction and terminating at a distal terminal end and a proximal direction and terminating at a proximal terminal end, the first stiffener having a first width that tapers in a direction from the distal terminal ends of the first stiffener to the proximal terminal ends of the first stiffener, so that the first width at the distal terminal ends is greater than the first width at the proximal terminal ends;

the first integral connecting bridge joining the first and second longitudinal arms at a location between the proximal terminal end and the distal terminal ends of each of the longitudinal arms;

a second non-rigid stiffener secured to the base having a second integral connecting bridge and a third and fourth longitudinal arm, the third and fourth longitudinal arms being generally straight and integral to the second bridge and extending independently therefrom in a distal direction and terminating at a distal terminal end and a proximal direction and terminating at a proximal terminal end, the second stiffener having a second width that tapers in a direction from the distal terminal ends of the second stiffener to the proximal terminal ends of the second stiffener, so that the second width at the distal terminal ends is greater than the second width at the proximal terminal ends;

the second integral connecting bridge joining the third and fourth longitudinal arms at a location between the proximal terminal end and the distal terminal end of each of the longitudinal arms;

the first and second stiffeners are each located on a dorsal side of a wearing hand when the glove is worn, wherein the distal terminal end of each longitudinal arm does not extend beyond a distal end of the wearing hand third metacarpal bone.

8. The glove of claim 7, wherein the base includes finger portions partially covering the second through fifth digits of the wearing hand, and further comprising:

a one-piece protective panel attached to the base and covering at least part of each of the finger portions, the protective panel positioned on a palmar side of the base when the glove is worn.

9. The glove of claim 8, wherein the protective panel includes a first cut-out formed therein, the first cut-out located on an ulnar side of the protective panel near the distal end of the wearing hand fifth metacarpal bone, the first cut-out extends in a cross-palm direction toward the wearing hand second metacarpal bone, the protective panel includes a second cut-out formed therein, the second cut-out lying approximately along the wearing hand centerline.

10. The glove of claim 7, wherein the first and second stiffeners are identical and placed on the glove in different orientations.

11. The glove of claim 7, wherein the second arm is longer than the first arm and the third arm is longer than the fourth arm, and the first integral connecting bridge is located approximately halfway between the proximal terminal end and the distal terminal end of the first arm, and the second integral connecting bridge is located approximately halfway between the proximal terminal end and the distal terminal end of the fourth arm.

12. The glove of claim 7, further including a wrist strap configured to wrap around a wearing hand wrist when the glove is worn, the wrist strap having a leading end attached to the base and a trailing end, the wrist strap further having a raised portion approximately adjacent to an edge of the trailing end, the raised portion being sized and located to assist gripping of the trailing end.

13. The glove of claim 12, wherein the first stiffener is positioned such that, when the glove is worn and the wrist strap is fastened around the wearing hand wrist, the connecting bridge is positioned closer to a distal edge of the wrist strap than to the distal end of the wearing hand third metacarpal bone.

14. The glove of claim 12, wherein the base includes finger portions partially covering the second through fifth digits of the wearing hand, and further comprising:

a one-piece protective panel attached to the base and covering at least part of each of the finger portions, the protective panel positioned on a palmar side of the base when the glove is worn.

15. The glove of claim 14, wherein the protective panel includes a first cut-out formed therein, the first cut-out located on an ulnar side of the protective panel near the distal end of the wearing hand fifth metacarpal bone, the first cut-out extends in a cross-palm direction toward the wearing hand second metacarpal bone, the protective panel includes a second cut-out formed therein, the second cut-out lying approximately along the wearing hand centerline.

16. The glove of claim 15, further comprising a second stiffener independent of the first stiffener, the second stiffener also being positioned on a dorsal side of the wearing hand when the glove is worn.

* * * * *